US010605000B2

(12) United States Patent
Hall et al.

(10) Patent No.: US 10,605,000 B2
(45) Date of Patent: Mar. 31, 2020

(54) WINDOW BLINDS THAT COLLECT DUST FROM AIR USING ELECTROSTATIC CHARGE

(71) Applicants: David R. Hall, Provo, UT (US); Austin Carlson, Provo, UT (US); Emily Brimhall, Alpine, UT (US); Terrece Pearman, Draper, UT (US); Jennifer Stevens, Provo, UT (US)

(72) Inventors: David R. Hall, Provo, UT (US); Austin Carlson, Provo, UT (US); Emily Brimhall, Alpine, UT (US); Terrece Pearman, Draper, UT (US); Jennifer Stevens, Provo, UT (US)

(73) Assignee: Hall Labs LLC, Provo, UT (US)

( * ) Notice: Subject to any disclaimer, the term of this patent is extended or adjusted under 35 U.S.C. 154(b) by 217 days.

(21) Appl. No.: 15/451,942

(22) Filed: Mar. 7, 2017

(65) Prior Publication Data

US 2018/0258693 A1 Sep. 13, 2018

(51) Int. Cl.
*E06B 9/386* (2006.01)
*B03C 3/28* (2006.01)
(Continued)

(52) U.S. Cl.
CPC ..... *E06B 9/386* (2013.01); *A47L 4/00* (2013.01); *B03C 3/017* (2013.01); *B03C 3/28* (2013.01); *E06B 9/28* (2013.01); *B08B 17/04* (2013.01)

(58) Field of Classification Search
CPC . E06B 9/386; E06B 9/28; B03C 3/017; B03C 3/28; A47L 4/00; B08B 17/04
See application file for complete search history.

(56) References Cited

U.S. PATENT DOCUMENTS 3,472,305 A * 10/1969 Lefes ..... E06B 9/386 156/65
4,231,766 A * 11/1980 Spurgin ..... B03C 3/12 96/79

(Continued)

FOREIGN PATENT DOCUMENTS

CN 204457382 U * 7/2015
CN 105840082 A * 8/2016

(Continued)

OTHER PUBLICATIONS

Zhao, Dongshun; Machine translation of CN 204457382; retrieved from https://worldwide.espacenet.com/publicationDetails/biblio?CC=CN&NR=204457382U&KC=U&FT=D&ND=4&date=20150708&DB=&locale=; 2015 (Year: 2015).*

*Primary Examiner* — Katherine W Mitchell
*Assistant Examiner* — Abe Massad

(57) ABSTRACT

We disclose a window blind which purifies the surrounding air using electrostatic interactions. The window blind includes slats which may have a strip of positively charged material, a strip of negatively charged material, or both attached to the top of the slat. In some embodiments, the positively charged material and the negatively charged material are attached to alternating slats. In other embodiments, the positively charged material and the negatively charged material are attached to the top of the same slate with a strip of insulating material positioned between them. The window blind may include an air-moving device which moves air past the slats so that dust particles with either a net positive charge or net negative charge may be attracted to the oppositely charged material on the slat. The air-moving device may be a vacuum or a fan. The positively and negatively charged materials may be removeable for cleaning.

9 Claims, 9 Drawing Sheets

(51) Int. Cl.

| | |
|---|---|
| ***E06B 9/28*** | (2006.01) |
| ***A47L 4/00*** | (2006.01) |
| ***B03C 3/017*** | (2006.01) |
| *B08B 17/04* | (2006.01) |

(56) References Cited

U.S. PATENT DOCUMENTS

| | | | | | |
|---|---|---|---|---|---|
| 5,215,558 | A * | 6/1993 | Moon | B03C 3/41 | 96/62 |
| 5,263,529 | A * | 11/1993 | Landis | B44C 1/1733 | 160/236 |
| 5,433,772 | A * | 7/1995 | Sikora | B03C 3/32 | 422/120 |
| 5,681,374 | A * | 10/1997 | Von Glehn | B01D 46/0023 | 96/16 |
| 5,718,273 | A * | 2/1998 | Best | E06B 9/303 | 160/166.1 |
| 6,852,149 | B2 * | 2/2005 | Huang | B03C 3/47 | 96/100 |
| 7,029,520 | B2 * | 4/2006 | Park | B01D 46/10 | 96/66 |
| 2006/0144531 | A1 * | 7/2006 | Reiss-Schmidt | E06B 9/522 | 160/330 |
| 2007/0192972 | A9 * | 8/2007 | Kimball | A47L 13/38 | 15/1.52 |
| 2017/0333992 | A1 * | 11/2017 | Gao | B22F 3/11 | |
| 2018/0258690 | A1 * | 9/2018 | Hall | E06B 9/28 | |

FOREIGN PATENT DOCUMENTS

| | | | | | |
|---|---|---|---|---|---|
| CN | 107237597 | A * | 10/2017 | | |
| WO | WO-2016066140 | A1 * | 5/2016 | B22F 3/11 | |

* cited by examiner

WINDOW BLINDS THAT COLLECT DUST FROM AIR USING ELECTROSTATIC CHARGE

BACKGROUND

Field of the Invention

This disclosure relates to window blinds, specifically window blinds which filter dust particles from the air.

Background of the Invention

Standard window blinds regularly get dirty and need to be cleaned. This process can be tedious and time consuming. Dust particles in a room can pose health challenges for individuals with respiratory problems, such as asthma.

Dust particles in a house can acquire a net positive or net negative charge. These particles can be attracted to materials with an opposite net charge through electrostatic forces. The electrostatic forces may be sufficient for a charged material to remove dust particles from the air and hold them until the charged material can be cleaned.

It is desirable to have a window blind with slats that are easily cleaned to remove dust. It is also desirable to have devices in a room which remove dust particles from the room for the health and comfort of the inhabitants of the room. Consequently, a window blind is needed which filters dust particles using only the electrostatic force of materials attached directly to the window blind slats, which can then be removed and cleaned periodically.

BRIEF SUMMARY OF THE INVENTION

We disclose a window blind that may filter dust particles from air by attracting dust particles that have a net charge to a material of opposite charge on the slats of the window blinds. Dust particles in air may be either positively charged or negatively charged. They are attracted to materials that comprise an opposite net charge. The disclosed window blind includes multiple slats. The top side of each of the slats may include either a strip of positively charged material, a strip of negatively charged material, or both a strip of positively charged material and a strip of negatively charged material. In some embodiments, the strips of positively charged material and the strips of negatively charged material are attached to alternating slats. In embodiments which include a strip of positively charged material adjacent to a strip of negatively charged material on the top of each slat, a strip of insulating material may separate the strip of positively charged material from the strip of negatively charged material so as to prevent a circuit from forming.

In order to direct the dust particles towards the slats so that they may be attracted to the charged materials on the slats through electrostatic forces, the disclosed window blind may include an air-moving device, which may be a fan or a vacuum. In some embodiments, the air-moving device is disposed within the headrail of the window blind. In other embodiments, the air-moving device is disposed within or attached to the bottom rail of the window blind. In some embodiments, air-moving device may be actuated by a remote device. In some embodiments, the remote device may be a mobile device.

To facilitate cleaning slats of the disclosed window blind, the positively and negatively charged materials may be easily removed from the slats. Both the positively and negatively charged materials may be machine washable.

This may allow a user to periodically remove the positively and/or negatively charged materials from the slats, clean them, and then reattach them to the slats of the window blind.

DETAILED DESCRIPTION OF THE INVENTION

Definitions

Figure 1:
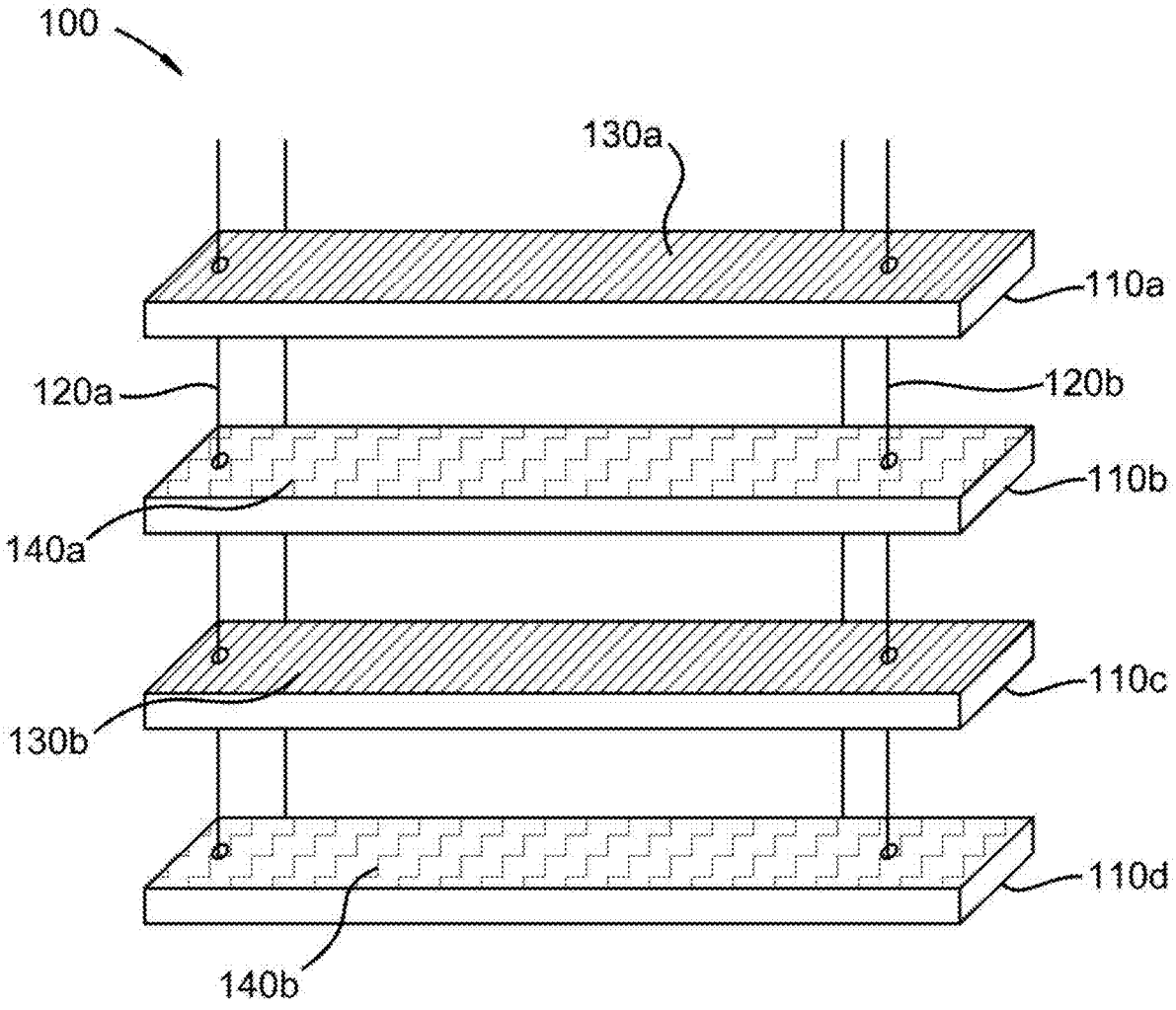
FIG. 1 illustrates an embodiment of the slats of the disclosed window blind in which alternating slats include either positively charged material or negatively charged material.

Window blinds, as used herein, means a blind that covers an opening in a building, including a window or door.

While this invention is susceptible of embodiment in many different forms, there are shown in the drawings, which will herein be described in detail, several specific embodiments with the understanding that the present disclosure is to be considered as an exemplification of the principals of the invention and is not intended to limit the invention to the illustrated embodiments.

We disclose a window blind that may filter dust particles from air using electrostatic forces, similar to an electrostatic air purifier. Dust particles in air may acquire a net positive charge or a net negative charge. The charged dust particles are attracted to materials that comprise an opposite net charge. The disclosed window blind includes multiple slats, each of which includes a top and a bottom side as well as two longitudinal sides and two transverse sides. The top side of each of the slats may include either a strip of positively charged material, a strip of negatively charged material, or both a strip of positively charged material and a strip of negatively charged material. In some embodiments, the strips of positively charged material and the strips of negatively charged material are attached to alternating slats. For example, odd numbered slats may have positively charged material attached to them and even numbered slats may have negatively charged material attached to them, or visa-versa. In embodiments which include a strip of positively charged material adjacent to a strip of negatively charged material on each slat, a strip of insulating material may separate the strip of positively charged material from the strip of negatively charged material so as to prevent a circuit from forming. In embodiments in which the slats are made of a material which may conduct electricity and where the charged materials are adjacent to each other on each slat, a slat may include a strip of insulating material between the charged material and the slat. The strips of positively charged material may be constructed of one or more of the following materials: nylon, wool, silk, hair, fur, and microfiber. Other positively charged material known in the art may be included in the strips of positively charged material on the slats. The negatively charged material may be constructed from one or more of the following materials: polyester, polyurethane, polypropylene, polyvinylchloride, polyvinylidene chloride, and Teflon. Other negatively charged material known in the art may be included in the strips of negatively charged material on the slats. In embodiments that include a strip of insulating material between the positively charged material and the negatively charged material, the insulating material may include one or more of the following materials: porcelain, plastic, rubber, and immobilized sand. Other material known in the art to insulate electrostatic charge may be included in the insulating material.

Standard house dust includes both positively charged particles and negatively charged particles. Each particle is attracted to a material of the opposite charge. However, the net positive or negative charge of each dust particle may be small. Therefore, it may be helpful to direct the dust particles to pass more closely to the slats so that they may be attracted to the charged materials on the slats by electrostatic forces. Accordingly, the disclosed window blind may include an air-moving device. In some embodiments, the air-moving device may be a fan or a vacuum. In some embodiments, the air-moving device is disposed within the headrail of the window blind. In other embodiments, the air-moving device is disposed within or attached to the bottom rail of the window blind. Whether the air-moving device is in the headrail or bottom rail of the window blind, the air-moving device moves air past the slats so that the slats may extract dust particles from the air. In some embodiments, air-moving device may be actuated by a remote device. In some embodiments, the remote device may be a mobile device. This may allow the user to select when and how often the air-moving device is turned on.

The positively and negatively charged materials may be removably attached to each of the plurality of slats by one or more of the following methods: hook and loop fasteners, snaps, clamps, clips, hook and eye fasteners, nuts and bolts, and adhesive. In any embodiment, both the positively and negatively charged materials may be machine washable. This may allow a user to periodically remove the positively and/or negatively charged materials from the plurality of slats, clean them, then reattach them to the slats of the window blind.

Referring now to the drawings, FIG. 1 illustrates window blind 100, which is an embodiment of the current disclosure. Window blind 100 includes slats 110*a*-110*d* and which are connected to tilt strings 120*a* and 120*b*. The angles of slats 110*a*-110*d* may be adjusted by moving tilt strings 120*a* and 120*b*. In this embodiment, positively charged materials 130*a* and 130*b* are attached to slats 110*a* and 110*c*, respectively. Positively charged materials 130*a* and 130*b* may be made of the same or different positively charged materials. Slats 110*a* and 110*c* alternate with slats 110*b* and 110*d*, which have negatively charged materials 140*a* and 140*b* attached to them, respectively. Negatively charged materials 140*a* and 140*b* may be made of the same or different negatively charged materials.

Figure 2:
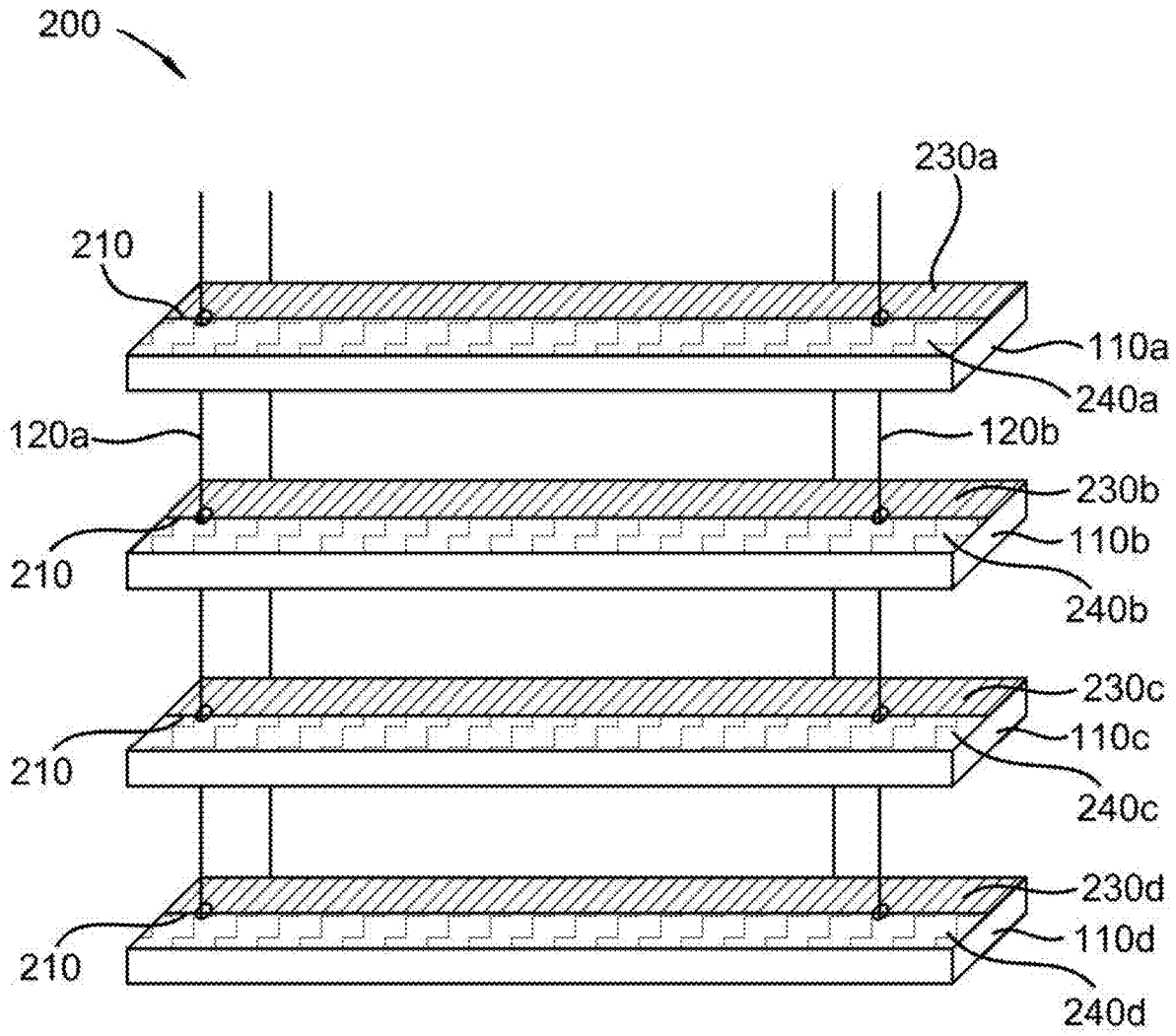
FIG. 2 illustrates an embodiment of the slats of the disclosed window blind in which each slat includes a strip of positively charged material and a strip of negatively charged material.

FIG. 2 illustrates window blind 200, which is another embodiment of the disclosed window blind. Window blind 200 includes slats 110*a*-110*d* and tilt strings 120*a*-120*b*. The angles of slats 110*a*-110*d* may be adjusted by moving tilt strings 120*a* and 120*b*. Slat 110*a*, includes positively charged material 230*a*, insulating material 210, and negatively charged material 240*a*. Slats 110*b*-110*d* include similar components corresponding to positively charged material 230*b*-230*d*, insulating material 210, and negatively charged material 240*b*-240*d*. In this embodiment, the charged materials are adjacent to each other on the top of each slat and are separated by a strip of insulating material 210. In addition, in some embodiments, insulating material 210 may extend beneath the charged materials on each slat if the slats are made of an electrically conductive material. This may prevent transfer of charge between the charged materials.

Figure 3A:
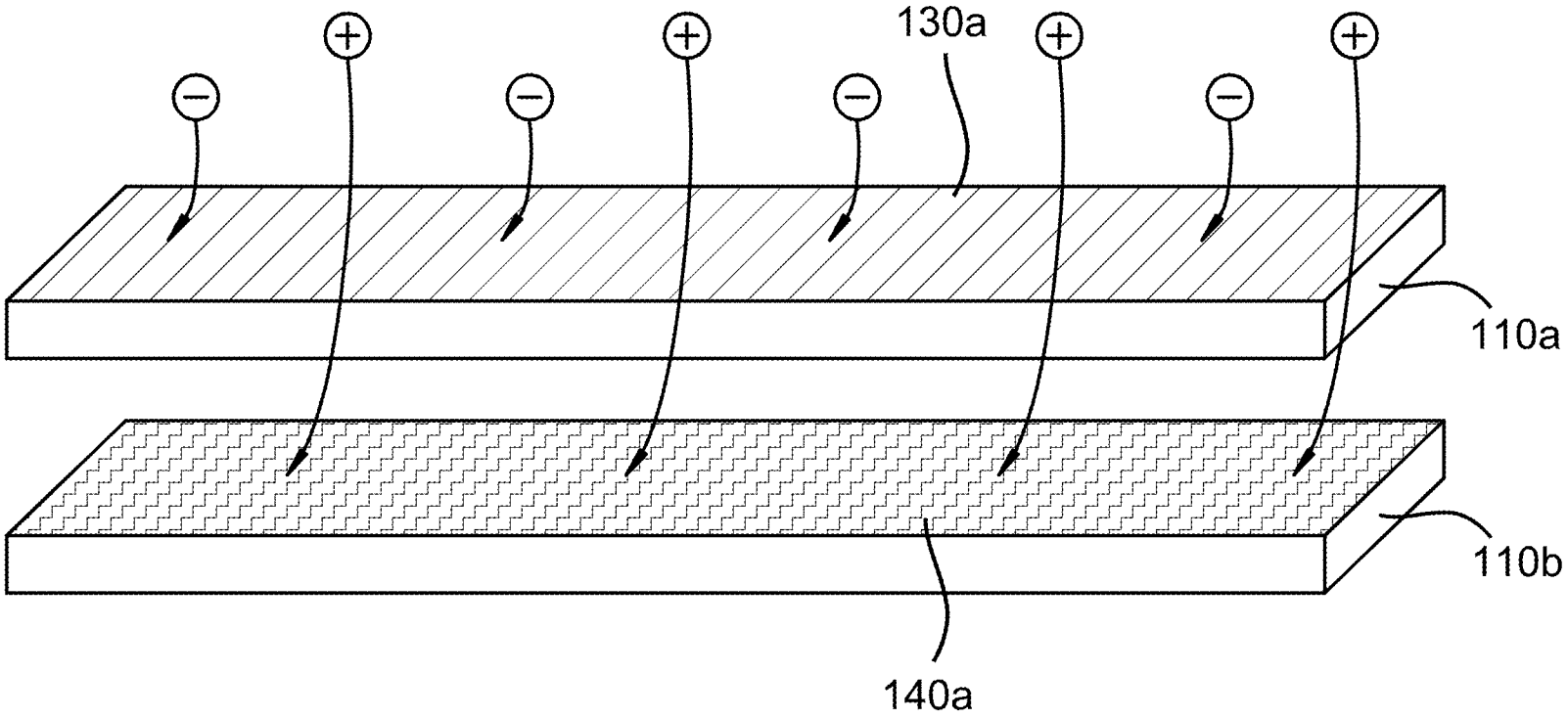
FIG. 3A illustrates the top two slats of the window blind illustrated in FIG. 1 with positively charged and negatively charged dust particles suspended in the surrounding air.

FIG. 3A is a close-up view of slats 110*a* and 110*b* from FIG. 1. It illustrates how the positively charged dust particles suspended in the air may be attracted towards negatively charged material 140*a* attached to slat 110*b*. Similarly, negatively charged dust particles suspended in the air may be attracted towards positively charged material 130*a* attached to slat 110*a*.

Figure 3B:
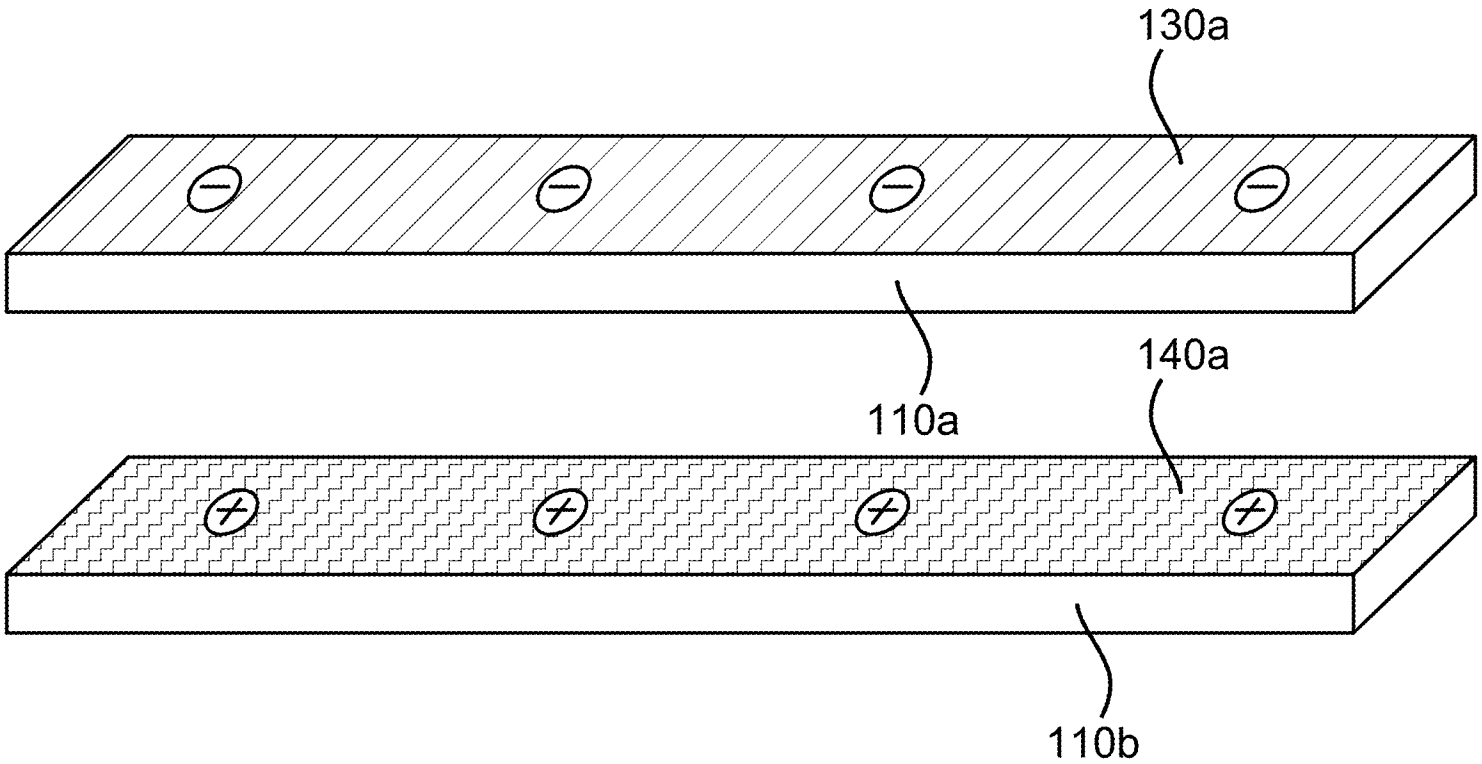
FIG. 3B illustrates the slats of FIG. 3A in which the positively charged material and negatively charged material have attracted dust particles of opposite charge.

Like FIG. 3A, FIG. 3B is a close-up view of slats 110*a* and 110*b* from FIG. 1. In FIG. 3B, the positively charged dust particles shown suspended in the air in FIG. 3A have been attracted to and adhered to negatively charged material 140*a* attached to slat 110*b*. Similarly, negatively charged dust particles shown suspended in the air in FIG. 4A have been attracted to and adhered to positively charged material 130*a* attached to slat 110*a*. This attraction may allow the charged materials to collect the dust particles from the air until the charged materials are saturated and ready for cleaning.

Figure 4A:
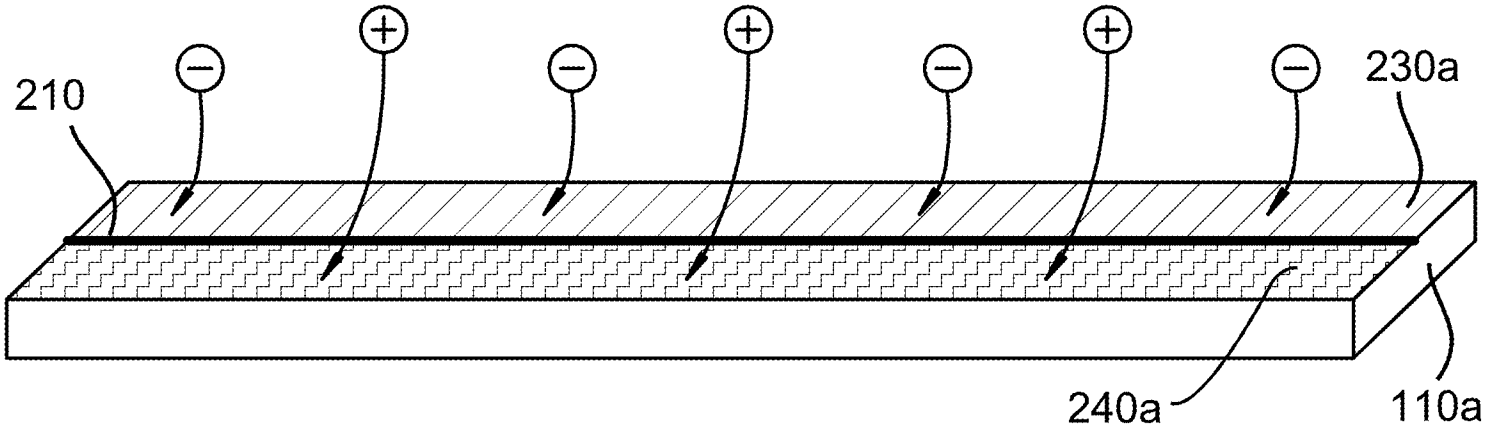
FIG. 4A illustrates the top slat of the window blind illustrated in FIG. 2 with positively charged and negatively charged dust particles suspended in the surrounding air.
Figure 4B:
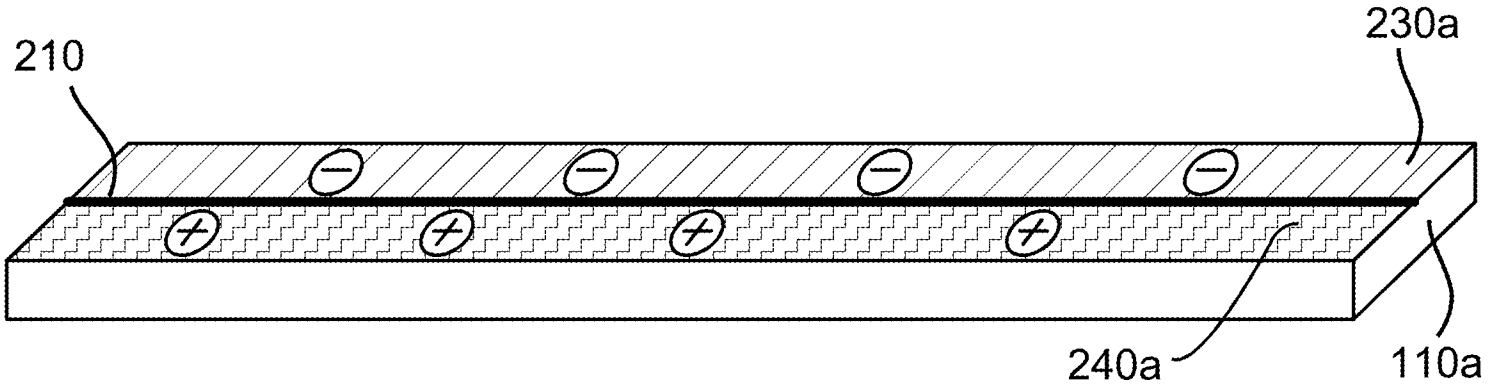
FIG. 4B illustrates the slat of FIG. 4A in which the positively charged material and the negatively charged material have attracted dust particles of opposite charge.

FIG. 4A is a close-up view of slat 110*a* FIG. 2. It illustrates positively and negatively charged dust particles suspended in the air, which may be attracted towards positively and negatively charged materials 230*a* and 240*a*, respectively. In this embodiment, positively charged material 230*a* is adjacent to negatively charged material 240*a*. The charged materials are separated by insulating material 210. FIG. 4B shows how the positively charged dust particles have been attracted to the negatively charged material 240*a*. Likewise, FIG. 4B shows how negatively charged dust particles have been attracted to positively charged material 230*a*. This attraction may allow the charged materials to collect the dust particles from the air until the charged materials are saturated and ready for cleaning.

Figure 5:
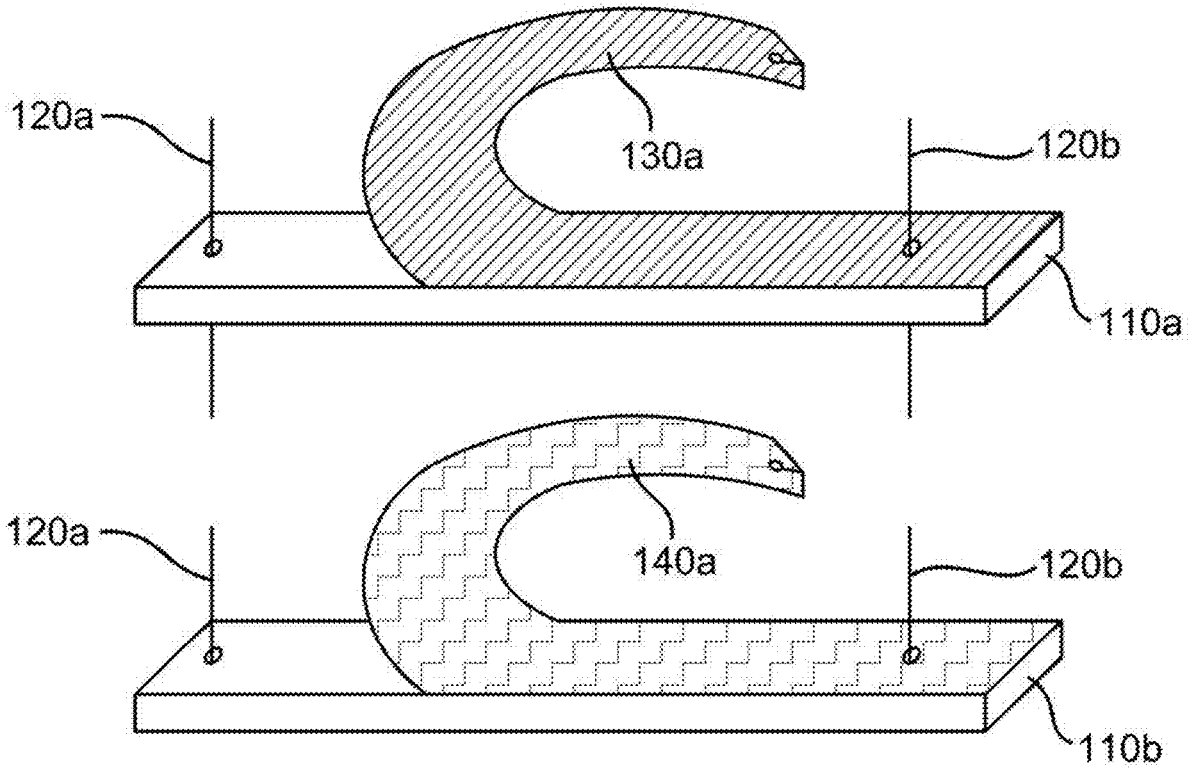
FIG. 5 illustrates the top two slats of the window blind illustrated in FIG. 1 with the positively charged material and negatively charged material in the process of being removed from the slat for cleaning.

FIG. 5 again illustrates the top two slats 110*a* and 110*b* from FIG. 1. Positively charged material 130*a* and negatively charged material 140*a* may both be removed from their respective slats for cleaning, as shown. In the embodiment shown in FIG. 5, positively charged material 130*a* and negatively charged material 140*a* are being peeled up from slats 110*a* and 110*b* respectively. The embodiment shown in FIG. 5 may include attachment material may be hook and loop fastening material. This type of fastening material makes positively charged material 130*a* and negatively charged material 140*a* easy to peel up then reattach after cleaning.

Figure 6:
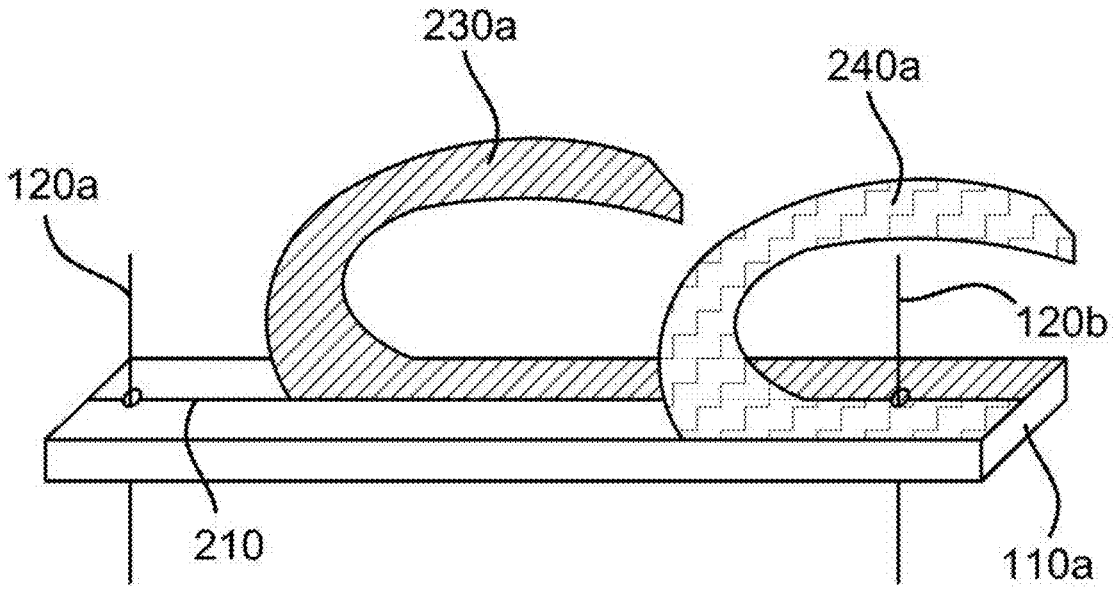
FIG. 6 illustrates the top slat of the window blind illustrated in FIG. 2 with the positively charged material and negatively charged material in the process of being removed from the slat for cleaning.

FIG. 6 illustrates the top slat 110*a* from FIG. 2. Positively charged material 230*a* and negatively charged material 240*a* may both be removed from slat 110*a* for cleaning, as shown. As in the embodiment shown in FIG. 5, the embodiment of FIG. 6 may include hook and loop fastening material allowing positively charged material 230*a* and negatively charged material 240*a* to be easily removed and reattached.

Figure 7A:
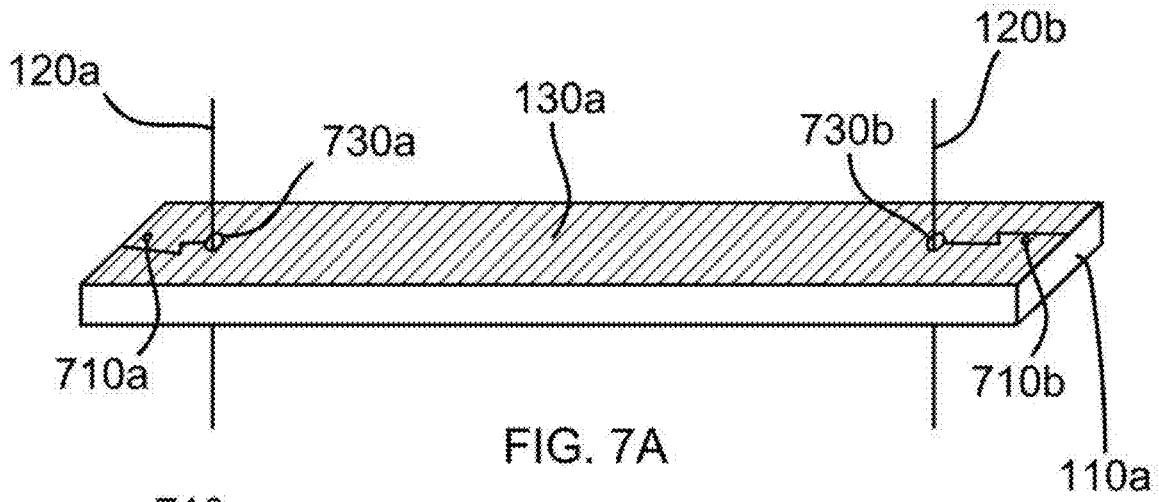
FIG. 7A illustrates the top slat of the window blind illustrated in FIG. 1 with the positively charged material attached to the slat using a snap fastener.
Figure 7B:
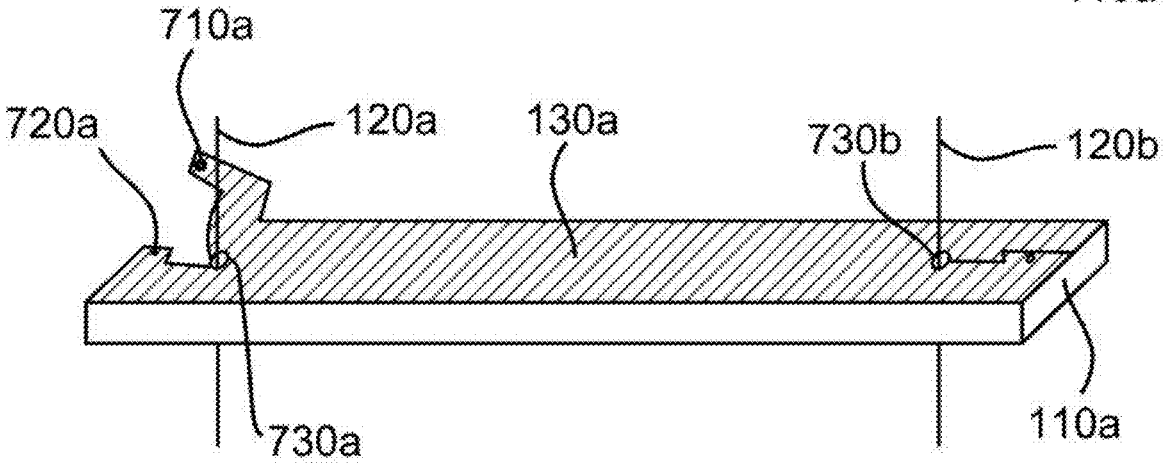
FIG. 7B illustrates the positively charged material on the slat of FIG. 7A being removed for cleaning by unfastening the snap fastener.

FIG. 7A illustrates an embodiment of the invention in which positively charged material 130*a* is removably attached to slat 110*a* with snap fasteners. FIG. 7A shows snap top pieces 710*a* and 710*b*. FIG. 7B illustrates the slat from FIG. 7A in which positively charged material 130*a* is in the process of being removed from slat 110*a* by unfastening the snap fasteners. FIG. 7A shows one snap fastener having been unfastened while the other snap fastener has not yet been unfastened. Specifically, snap top piece 710*a* has been separated from snap bottom piece 720*a* such that the positively charged material can be peeled upward and removed from around tilt string 120*a*.

FIGS. 7A and 7B show tilt strings 120*a* and 120*b* running through holes 730*a* and 730*b* respectively. The slit-type opening created by separating snap top piece 710*a* from snap bottom piece 720*a* fits around hole 730*a* so that positively charged material 130*a* fits around tilt string 120*a* when attached to slat 110*a*. The same design is used on the other end of slat 110*a* with tilt string 120*b* running through hole 730*b* and a slit-type opening being created when top piece 710*b* is separated from snap bottom piece 720*b*.

Figure 8:
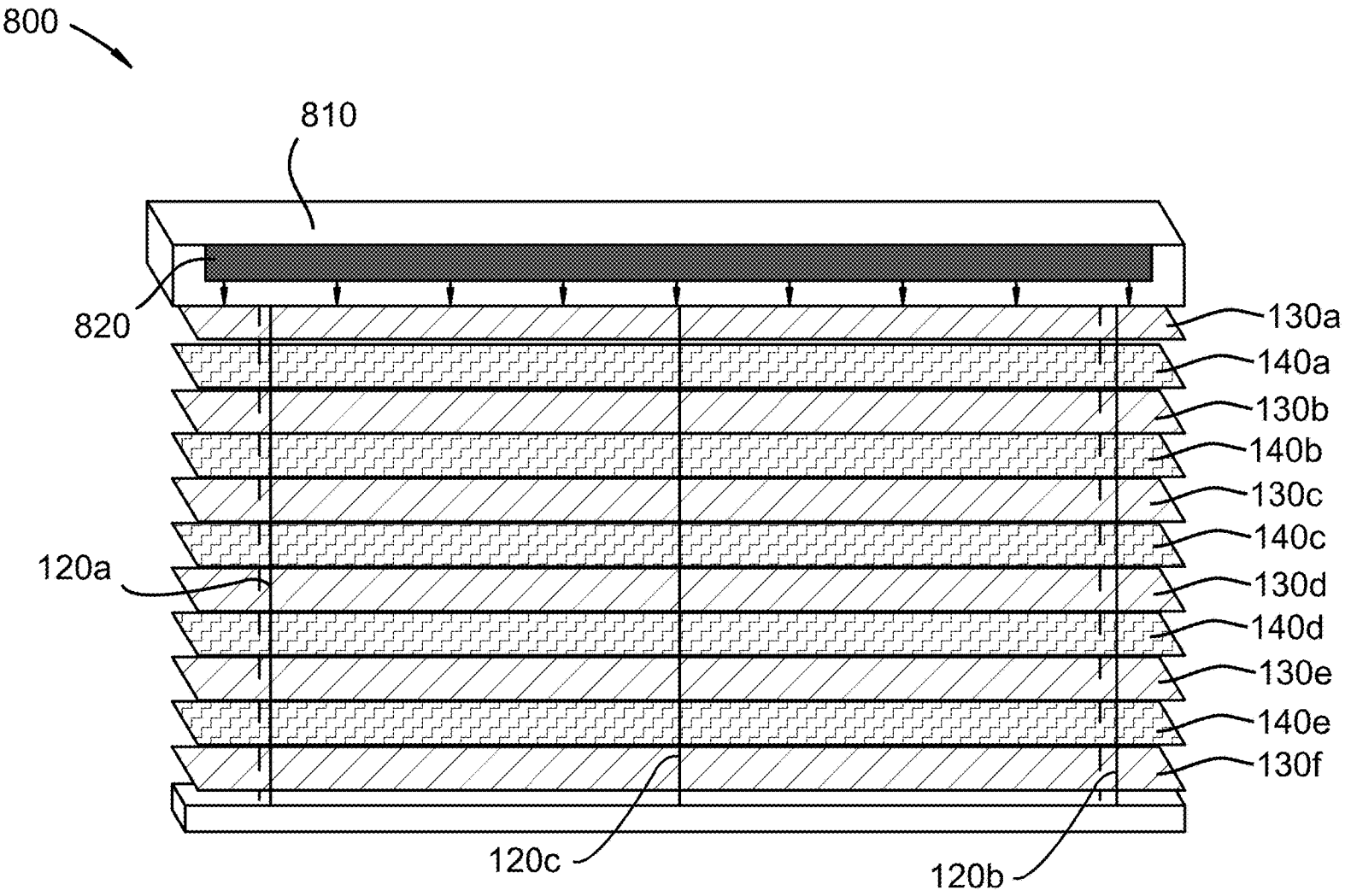
FIG. 8 illustrates an embodiment of the disclosed window blind with a fan in the headrail directing air flow towards the slats.

FIG. 8 shows window blind 800, which is another embodiment of the current disclosure. Window blind 800 includes headrail 810, air moving device 820, tilt strings 120*a*-120*c*, positively charged slats 130*a*-130*f*, and negatively charged slats 140*a*-140*e*. In this embodiment, positively charged slats 130*a*-130*f* are arranged to alternate with negatively charged slats 140*a*-140*e*. In this embodiment, air moving device 820 is disposed within headrail 810 such that it directs air flow over slats 130*a*-130*f* and slats 140*a*-140*e*. Air moving device 820 may be comprised of a fan or a vacuum. Tilt strings 120*a*-120*b* may be controlled in conjunction with air moving device 820. This control may allow the slats to open or close a desired amount in order to facilitate optimum air flow over the slats.

While specific embodiments have been illustrated and described above, it is to be understood that the disclosure provided is not limited to the precise configuration, steps, and components disclosed. Various modifications, changes, and variations apparent to those of skill in the art may be made in the arrangement, operation, and details of the methods and systems disclosed, with the aid of the present disclosure.

Without further elaboration, it is believed that one skilled in the art can use the preceding description to utilize the present disclosure to its fullest extent. The examples and embodiments disclosed herein are to be construed as merely illustrative and exemplary and not a limitation of the scope of the present disclosure in any way. It will be apparent to those having skill in the art that changes may be made to the details of the above-described embodiments without departing from the underlying principles of the disclosure herein.

We claim:

1. A window blind comprising:

a headrail;

a plurality of slats, each of the plurality of slats comprising:

a top side;

a bottom side;

a strip of positively charged material removably attached to the top side of a first subset of the plurality of slats;

a strip of negatively charged material removably attached to the top side of a second subset of the plurality of slats;

tilt strings coupled to each of the plurality of slats and configured to control a tilt angle of each of the plurality of slats; and air-moving device disposed within the headrail, wherein the air-moving device directs air toward the plurality of slats;

wherein each strip of positively charged material collects negatively charged particles;

and wherein each strip of negatively charged material collects positively charged particles;

wherein each strip of charged material is configured to be independently removable from the slat to which it is attached for cleaning;

wherein each strip of charged material is configured to be reattached to a slat once it has been cleaned; and wherein the tilt strings are controlled in conjunction with the air-moving device to control air flow over the slats.

2. The window blind of claim 1, wherein members of the first subset of the plurality of slats alternate with members of the second subset of the plurality of slats.

3. The window blind of claim 1, wherein the strip of positively charged material is selected from one or more of the following: nylon, wool, silk, hair, fur, and microfiber.

4. The window blind of claim 1, wherein the strip of negatively charged material is selected from one or more of the following: polyester, polyurethane, polypropylene, polyvinylchloride, polyvinylidene chloride, and Teflon.

5. The window blinds of claim 1, wherein the strip of positively charged material and the negatively charged material are able to be removed and cleaned in a washing machine.

6. The window blinds of claim 1, wherein the strip of positively charged material and the negatively charged material are removably attached by one or more of the following: hook and loop fasteners, snaps, clamps, clips, hook and eye fasteners, nuts and bolts, and adhesive.

7. The window blinds of claim 1, wherein the air-moving device comprises a fan.

8. The window blinds of claim 1, wherein the air-moving device comprises a vacuum.

9. The window blinds of claim 1, wherein the air-moving device is actuated by a remote device.

* * * * *